US009121581B2

(12) United States Patent
Peng

(10) Patent No.: US 9,121,581 B2
(45) Date of Patent: Sep. 1, 2015

(54) LED CHRISTMAS LIGHT WITH FOUR CONNECTION PINS

(71) Applicant: Mei-Ling Peng, Taipei (TW)

(72) Inventor: Mei-Ling Peng, Taipei (TW)

( * ) Notice: Subject to any disclaimer, the term of this patent is extended or adjusted under 35 U.S.C. 154(b) by 29 days.

(21) Appl. No.: 14/091,348

(22) Filed: Nov. 27, 2013

(65) Prior Publication Data

US 2015/0146454 A1 May 28, 2015

(51) Int. Cl.
*H01R 33/00* (2006.01)
*F21V 19/00* (2006.01)

(52) U.S. Cl.
CPC ..... *F21V 19/0005* (2013.01)

(58) Field of Classification Search
CPC ..... F21V 19/0005
USPC ..... 362/653, 654
See application file for complete search history.

(56) References Cited

U.S. PATENT DOCUMENTS 8,132,956 B2 * 3/2012 Hsu ..... 362/653
2012/0268938 A1 * 10/2012 Peng ..... 362/249.06

* cited by examiner

*Primary Examiner* — Meghan Dunwiddie
(74) *Attorney, Agent, or Firm* — Leong C. Lei

(57) ABSTRACT

The present invention proposes a LED Christmas light, using an LED bulb with four connection pins to insert in a soft core configured with four through holes allowing the four connection pins to be passed through and bended configured on the bottom thereof, and the soft core being inserted in a soft head with four convex plates in pairs face-to-face and extended to the bottom face thereof configured on the inside thereof, where an engagement space is formed between each two adjacent convex plates in the soft head, allowing four metal conducting sheets with a conducting wire to be engaged therewith, and a blocking plate adapted to isolate the conducting wire of each metal conducting sheet is configured on the center of a face of each convex plate, thereby allowing one LED Christmas light unit to use an LED bulb with a light source of more than four colors.

1 Claim, 3 Drawing Sheets

LED CHRISTMAS LIGHT WITH FOUR CONNECTION PINS

TECHNICAL FIELD OF THE INVENTION

The present invention relates to an LED Christmas light structure, and more particularly to a Christmas light unit structure in a Christmas light string.

DESCRIPTION OF THE PRIOR ART

An LED decoration light, such as an LED light used in a Christmas light string, as FIG. 1 shows, is constituted by components such as a LED bulb (10), soft core (20) and soft head (30). Conventionally, a general LED bulb (10) have two pins respectively coupled to the soft core (20), and two metal conducting sheets (41) with a conducting wire (40) are respectively configured on two inner sides of the soft head (30), allowing the two pins (11) of the LED bulb (10) to be respectively in conducting contact with the two metal conducting sheets (41) when the soft core (20) connected with the LED bulb (10) is inserted in the soft head (30), thereby combining a plurality of LED decoration light units into an entire Christmas light string.

Because luminous bodies of the current LED bulbs (10) have been developed to multi-color sources having more than three colors, it enables the LED bulbs (10) to perform a more diversified color change. But, the LED bulb (10) with two pins of the current Christmas light only can have a luminous body of three colors at most, incapable of upgrading the color change of a Christmas light and conforming to requirements.

SUMMARY OF THE INVENTION

Thus, the main object of the present invention is to provide a LED Christmas light, using an LED bulb with four connection pins to insert in a soft core configured with four through holes allowing the four connection pins to be passed through and bended configured on the bottom thereof, and the soft core being inserted in a soft head with four convex plates in pairs face-to-face and extended to the bottom face thereof configured on the inside thereof, where an engagement space is formed between each two adjacent convex plates in the soft head, allowing four metal conducting sheets with a conducting wire to be engaged therewith, and a blocking plate adapted to isolate the conducting wire of each metal conducting sheet is configured on the center of a face of each convex plate, thereby allowing one LED Christmas light unit to use an LED bulb with a light source of more than four colors, and the LED Christmas light to be more colorful and variable.

DETAILED DESCRIPTION OF THE PREFERRED EMBODIMENTS

Figure 1:
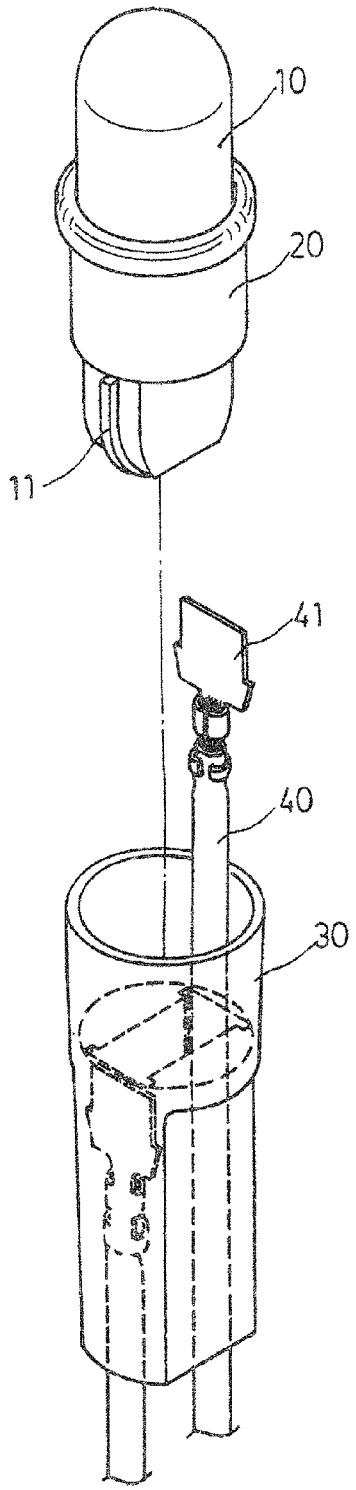
PRIOR ART FIG.1
FIG. 1 is a perspective view of a conventional LED Christmas light structure with two connection pins.
Figure 2:
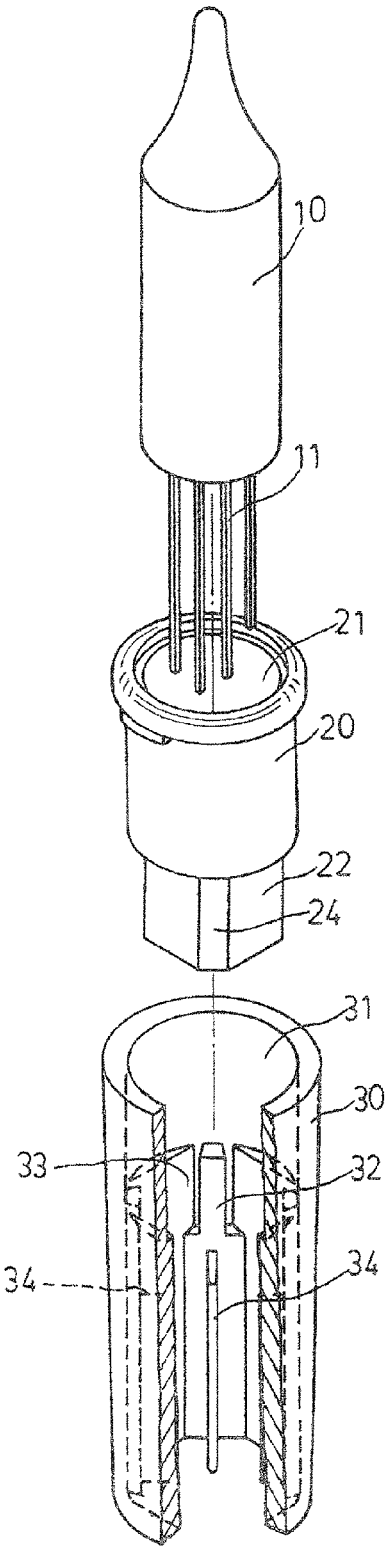
FIGS. 2 and 3 are exploded views of a structure of the present invention.
Figure 3:
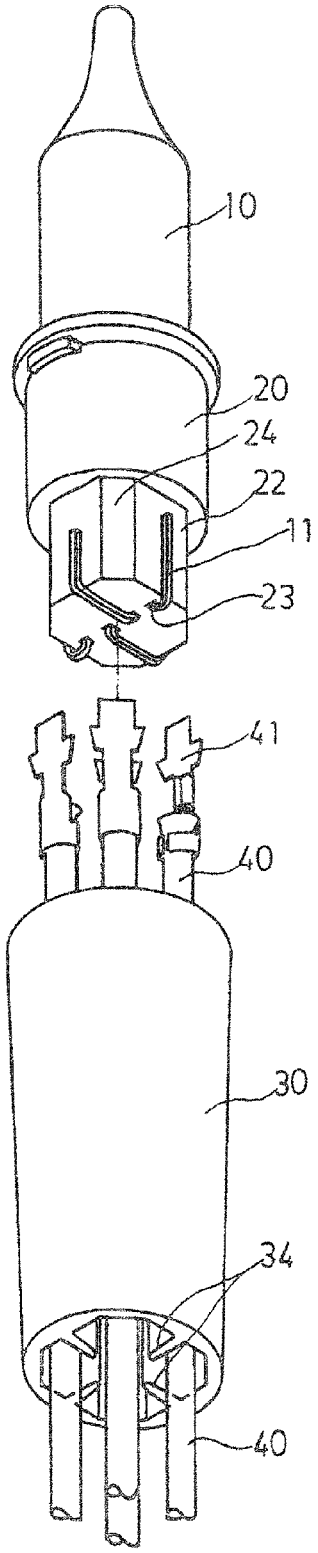
Figure 4:
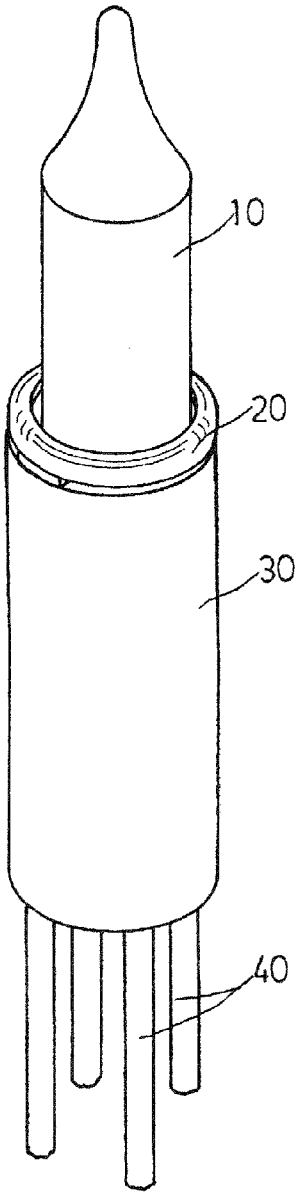
FIG. 4 is a perspective view of a structure of the present invention after assembly.

Referring to FIGS. 2 and 3, an LED Christmas light with four connection pins of the present invention mainly includes an LED bulb (10), soft core (20) and soft head (30), where the LED bulb (10) is configured with four connection pins (11) arranged in a single row on the bottom thereof, and the soft core (20) is configured with an opening formed into an accepting groove (21) on the top thereof and a square column formed into a base (22), four corners of which are cut into four inclined-faced edges (24). Furthermore, four through holes (23) arranged equidistantly in a row corresponding to the four connection pins (11) of the LED lamp (10) are configured on the bottom face of the base (22). In addition, the soft head (30) also has an opening formed into an accepting groove (31) on the top thereof, and four convex plates (32) in pairs face-to-face and extended to the bottom face of the soft head (30) are configured on the bottom edge of the accepting groove (31). Furthermore, an engagement space (33) is formed between each two adjacent convex plates (32), and a blocking plate (34) extended to the bottom face of the soft head (30) is configured on the center of a face of each convex plate (32).

Figure 5:
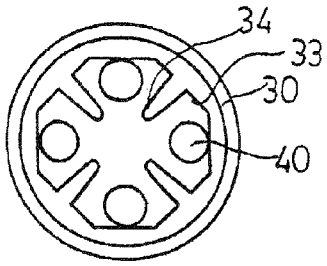
FIG. 5 is a bottom view of a structure of the present invention.
Figure 6:
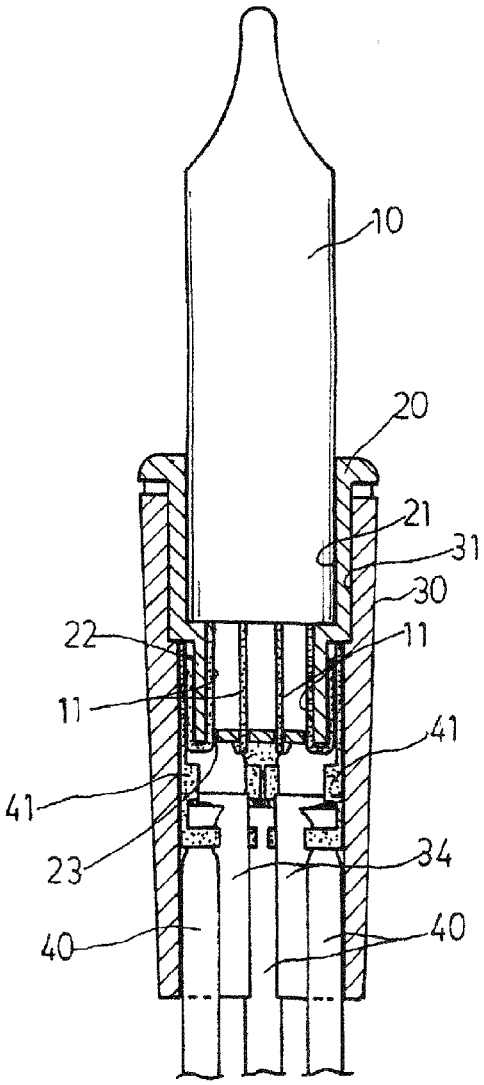
FIG. 6 is a cross-sectional view of a structure of the present invention.

Referring to FIGS. 2 to 6, the LED bulb (10) is inserted in the accepting groove (21) of the soft core (20), and the four connection pins (11) are respectively passed through the four through holes (23) and respectively bended to attach to the four side faces of the base (22). In addition, four metal conducting sheets (41) with a conducting wire (40) are placed in the soft head (30) through the bottom thereof and respectively engaged with the four engagement spaces (33). Thereafter, the soft core (20) assembled with the LED bulb (10) is inserted in the accepting groove (31) of the soft head (30); the connection pins (11) on the four side faces of the base (22) respectively are in conducting contact with the four metal conducting sheets (41) on the engagement space (33) of the soft head (30). Meanwhile, the four inclined-faced edges (24) on the base (22) are respectively attached closely to upper-half portions of the convex plates (32) to isolate the four metal conducting sheets (41) completely, as FIGS. 5 and 6 show, and the blocking plates (34) on the four convex plates (32) respectively isolate the conducting wires (41) coupled to the four metal conducting sheets (41), thereby allowing one LED Christmas light unit to use an LED bulb with a light source of more than four colors, and the LED Christmas light to be more colorful and variable.

I claim:

1. An LED Christmas light with four connection pins, comprising an LED bulb, soft core and soft head, said LED bulb having a four connection pins arranged in a single row, said soft core being configured with an accepting groove allowing said LED bulb to be inserted therein, and a bottom portion of said soft core being formed into a base with four corners respectively being a inclined-faced edge, said base being configured with four through holes arranged in a single row on a bottom face thereof allowing said four pins of said LED bulb to be passed through and bended to attach to a surface of said base, said soft head being also configured with an accepting groove allowing said soft core to be inserted in, said accepting groove being configured with four convex plates in pairs face-to-face and extended to a bottom face of said soft head, a blocking plate being configured on a center of a face of each said convex plate, an engagement space being formed between each two adjacent convex plates allowing each of four metal conducting sheets with a conducting wire to be engaged therewith.

* * * * *